US009332827B2

(12) United States Patent
Lee

(10) Patent No.: US 9,332,827 B2
(45) Date of Patent: May 10, 2016

(54) ORAL CARE KIT AND DISPENSER FOR USE WITH THE SAME

(75) Inventor: David K. Lee, East Brunswick, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 419 days.

(21) Appl. No.: 13/992,159

(22) PCT Filed: Dec. 15, 2010

(86) PCT No.: PCT/US2010/060534

§ 371 (c)(1),
(2), (4) Date: Jun. 6, 2013

(87) PCT Pub. No.: WO2012/082119

PCT Pub. Date: Jun. 21, 2012

(65) Prior Publication Data

US 2013/0252206 A1 Sep. 26, 2013

(51) Int. Cl.

| | |
|---|---|
| ***A46B 9/04*** | (2006.01) |
| ***A46B 11/00*** | (2006.01) |
| ***A46B 15/00*** | (2006.01) |
| ***A46B 17/00*** | (2006.01) |
| ***B65D 75/36*** | (2006.01) |
| ***B65D 83/04*** | (2006.01) |

(52) U.S. Cl.

CPC . *A46B 9/04* (2013.01); *A46B 11/00* (2013.01); *A46B 11/0003* (2013.01); *A46B 15/0091* (2013.01); *A46B 15/0093* (2013.01); *A46B 17/00* (2013.01); *B65D 75/367* (2013.01); *B65D 83/0409* (2013.01)

(58) Field of Classification Search

CPC combination set(s) only.
See application file for complete search history.

(56) References Cited

U.S. PATENT DOCUMENTS

| | | | | |
|---|---|---|---|---|
| 1,411,681 | A | 4/1922 | Burlew | |
| RE19,006 | E | 11/1933 | Graves | |
| 1,950,767 | A | 3/1934 | Herman | |
| 1,995,374 | A * | 3/1935 | Young | A46B 11/00 206/540 |

(Continued)

FOREIGN PATENT DOCUMENTS

| | | |
|---|---|---|
| DE | 894 146 | 10/1953 |
| JP | 2002-326675 | 11/2002 |

(Continued)

OTHER PUBLICATIONS

International Search Report and the Written Opinion of the International Searching Authority issued in International Application PCT/US2010/060534 mailed Nov. 7, 2011.

*Primary Examiner* — David Walczak

(57) ABSTRACT

An oral care kit comprising an oral care implement and a dispenser. In one aspect, the invention can be an oral care kit comprising at least one toothbrush and a dispenser. The dispenser (300) comprises a housing (309) having an internal chamber (321) containing a plurality of capsules (310) containing an oral care material; a dispensing conduit (322) extending from the internal chamber to an exterior of the dispenser; a valve (325) positioned in the dispensing conduit and biased into a sealed state that prevents moisture from entering the internal chamber; and a dispensing subassembly (302, 315, 316, 317) configured to dispense one of the capsules from the internal chamber through the valve. The valve is forced into an open state that allows the one capsule to pass therethrough when the one capsule is subjected to a dispensing force imparted by the dispensing subassembly and automatically returns to the sealed state after the one capsule passes therethrough.

25 Claims, 6 Drawing Sheets

(56) References Cited

U.S. PATENT DOCUMENTS

| | | | | |
|---|---|---|---|---|
| 2,262,982 | A | 11/1941 | Wolcott | |
| 3,018,921 | A * | 1/1962 | Hermanson | B65D 83/0409 206/807 |
| 3,191,803 | A | 6/1965 | Hamilton | |
| 3,471,056 | A | 10/1969 | Kovac | |
| 3,638,830 | A | 2/1972 | Belokin, Jr. | |
| 4,336,097 | A | 6/1982 | Van Kampen et al. | |
| 4,427,116 | A | 1/1984 | Brown | |
| 4,651,619 | A | 3/1987 | Voecks | |
| 4,807,757 | A | 2/1989 | Rappaport et al. | |
| 5,640,945 | A | 6/1997 | Slonaker et al. | |
| 5,664,697 | A | 9/1997 | Lambelet, Jr. et al. | |
| 6,098,835 | A | 8/2000 | DeJonge | |
| 6,155,454 | A | 12/2000 | George et al. | |
| 6,176,391 | B1 | 1/2001 | Rehkemper et al. | |
| 6,220,479 | B1 | 4/2001 | Fishman | |
| 6,726,058 | B2 * | 4/2004 | Giraud | B65D 83/0409 221/267 |
| 7,104,417 | B2 | 9/2006 | Hilliard | |
| 7,575,387 | B2 * | 8/2009 | Atkin | A46B 11/0006 401/132 |
| 7,665,923 | B2 | 2/2010 | Py et al. | |
| 8,459,892 | B2 | 6/2013 | Hohlbein et al. | |
| 8,851,781 | B2 | 10/2014 | Bartschi et al. | |
| 8,881,332 | B2 | 11/2014 | Noble et al. | |
| 2004/0118740 | A1 | 6/2004 | Donegan | |
| 2004/0237226 | A1 | 12/2004 | Hohlbein et al. | |
| 2008/0011773 | A1 | 1/2008 | Tobias | |
| 2008/0120798 | A1 | 5/2008 | Sorrentino et al. | |
| 2009/0044356 | A1 | 2/2009 | Noble et al. | |
| 2015/0083747 | A1 | 3/2015 | Noble et al. | |

FOREIGN PATENT DOCUMENTS

| | | |
|---|---|---|
| WO | WO 87/00425 | 1/1987 |
| WO | WO97/08078 | 3/1997 |
| WO | WO 2006/032367 | 3/2006 |

* cited by examiner

ORAL CARE KIT AND DISPENSER FOR USE WITH THE SAME

CROSS-REFERENCE OF RELATED APPLICATIONS

This application is a U.S. national stage entry under 35 U.S.C. §371 of Patent Cooperation Treaty Patent Application No. PCT/US2010/060534, filed Dec. 15, 2010, the entirety of which is incorporated herein by reference.

BACKGROUND OF THE INVENTION

The advantages of good dental hygiene are well known. Often, however, people either forget their toothbrushes when traveling or do not carry their toothbrushes outside of the home. Hotels, health care facilities, nursing homes, hospitals, daycare facilities, schools, airlines, etc. have a need for single use disposable or limited multiple use toothbrushes that may be economically supplied to and discarded by individuals without a toothbrush, a dentifrice and/or a water supply. Such toothbrushes could be used in vending machines or distributed in large quantities for simple, portable use at any location.

Various types of disposable, limited use or portable toothbrushes are known in the art. For example, some toothbrush systems have attempted to meet some of these needs by providing an oral care material within the toothbrush itself, through an integrated channel, for distribution through the toothbrush and around the bristles. Another approach is the development of an oral care implement having a moisture degradable capsule having an oral care material secured thereto during manufacturing.

It has recently been determined that packaging costs for portable oral care implements are unnecessarily high. One reason for this high cost is because portable oral care implements of the type described above must be maintained in a sealed environment during product manufacturing, packaging, shipping and display in order to maintain the integrity of the oral care material.

Thus, a need exists for a package and/or kit that can provide an economic solution to the packaging difficulties and costs discussed above, while still providing a suitable portable, waterless and/or disposable oral care implement.

BRIEF SUMMARY OF THE INVENTION

The present invention is directed to a kit comprising a toothbrush and a dispenser. The dispenser comprises a housing containing capsules containing an oral care material, a dispensing conduit, and a valve. The dispenser further comprises a dispensing subassembly that dispenses one of the capsules at a time. The dispenser can dispense the capsule directly onto the toothbrush of the kit.

In one aspect, the invention can be an oral care kit comprising: at least one toothbrush; and a dispenser comprising: a housing having an internal chamber containing a plurality of capsules containing an oral care material; a dispensing conduit extending from the internal chamber to an exterior of the dispenser; a valve positioned in the dispensing conduit, the valve biased into a sealed state that prevents moisture from entering the internal chamber through the dispensing conduit; a dispensing subassembly configured to dispense one of the plurality of capsules at a time from the internal chamber through the valve, the valve being forced into an open state that allows the one capsule to pass therethrough when the one capsule is subjected to a dispensing force imparted by the dispensing subassembly, the valve automatically returning to the sealed state after the one capsule passes through the valve.

In another aspect, the invention can be an oral care dispenser comprising: a housing having an internal chamber containing a plurality of capsules containing an oral care material; a dispensing conduit extending from the internal chamber to an exterior of the dispenser; a valve positioned in the dispensing conduit, the valve biased into a sealed state that prevents moisture from entering the internal chamber through the dispensing conduit; a dispensing subassembly configured to dispense one of the plurality of capsules at a time from the internal chamber through the valve, the valve being forced into an open state that allows the one capsule to pass therethrough when the one capsule is subjected to a dispensing force imparted by the dispensing subassembly, the valve automatically returning to the sealed state after the one capsule passes through the valve.

In still another aspect, the invention can be a method of applying an oral care material to an oral surface comprising: a) providing a toothbrush; b) providing a dispenser comprising: a housing having an internal chamber containing a plurality of capsules containing an oral care material; a dispensing conduit extending from the internal chamber to an exterior of the dispenser; a valve positioned in the dispensing conduit, the valve biased into a sealed state that prevents moisture from entering the internal chamber through the dispensing conduit; and a dispensing subassembly configured to dispense one of the plurality of capsules at a time from the internal chamber through the valve; c) positioning the dispenser adjacent the toothbrush; and d) activating the dispenser assembly, the dispenser subassembly imparting a dispensing force onto the one capsule, thereby forcing the one capsule through the valve and onto the toothbrush, the valve automatically returning to the sealed state after the one capsule passes through the valve.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
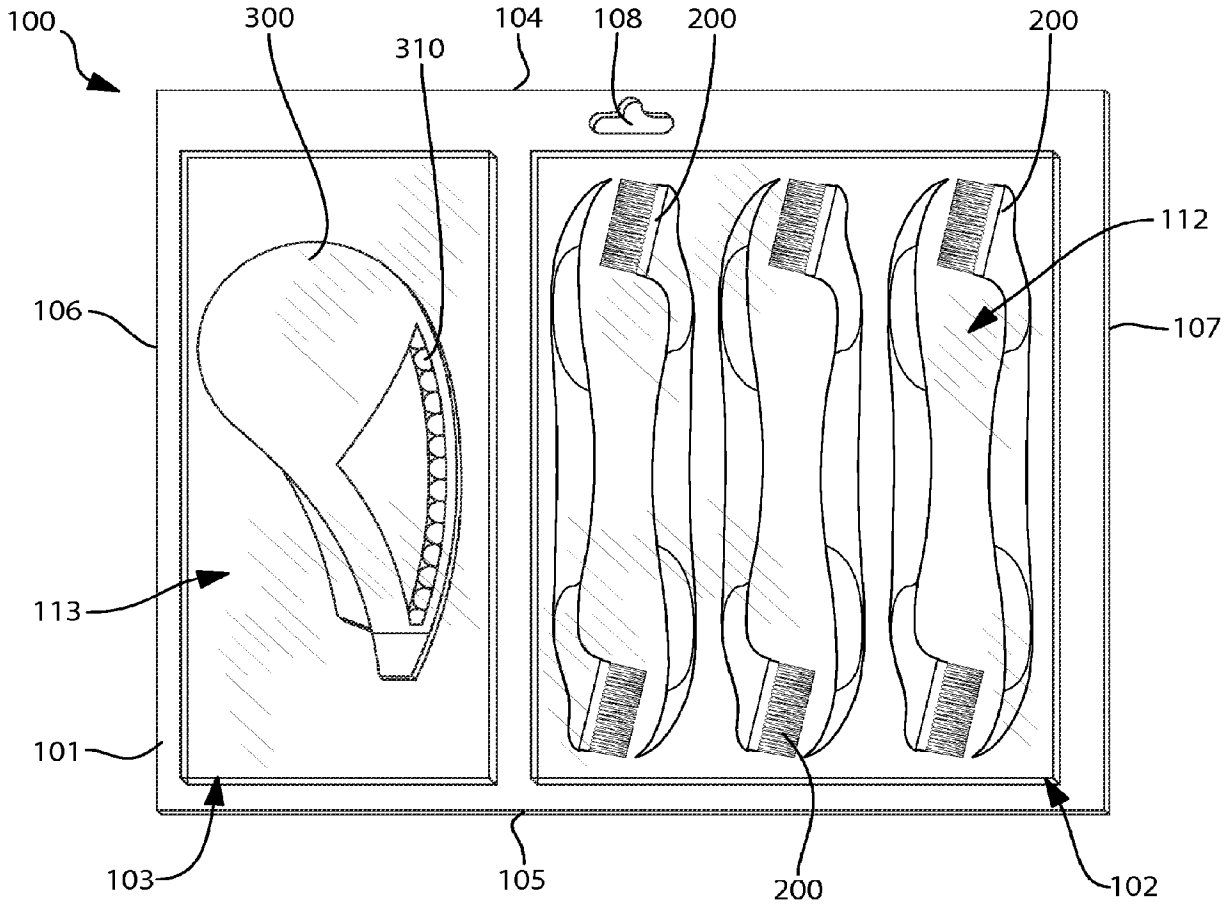
FIG. 1 is a front view of a kit containing a dispenser and a plurality of oral care implements in accordance with one embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of the exemplary embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top," "bottom," "front" and "rear" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," "secured" and similar refer to a relationship wherein structures are secured or attached to one another either directly or indirectly through intervening structures, as well as both movable or rigid attachments or relationships, unless expressly described otherwise. Moreover, the features and benefits of the invention are described by reference to the exemplary embodiments illustrated herein. Accordingly, the invention expressly should not be limited to such exemplary embodiments, even if indicated as being preferred. The discussion herein describes and illustrates some possible non-limiting combinations of features that may exist alone or in other combinations of features. The scope of the invention is defined by the claims appended hereto.

Referring to FIG. 1, a kit 100 comprising a plurality of oral care implements 200 and a dispenser 300 is illustrated. The oral care implements 200 and the dispenser 300 are bundled in the kit 100 so as to be displayed in retail stores as a single sale item at the point of sale. As will be better understood from the description below, the dispenser 300 and the oral care implements 200 can be used together in order to effectively treat a user's oral cavity, including teeth and/or soft oral tissue. However, in certain other embodiments, the dispenser 300 may be sold and used as a separate component from the oral care implements 200 and, as such, may constitute an embodiment of the present invention in of itself.

The oral care implements 200 and the dispenser 300 are located within a common primary package 101. The oral care implements 200 are located within a first compartment 102 of the primary package 101 while the dispenser 300 is located within a second compartment 103 of the primary package 101. Both of the first and second secondary compartments 102, 103 are formed within the primary package 101. In the exemplary embodiment, the primary package 101 is a clamshell package, such as a blister pack. Clamshell packages are preferable because they provide barrier protection for shelf life requirements and a degree of tamper resistance. Furthermore, clamshell packages have a low manufacturing cost and enable the items contained therein to be clearly displayed to a consumer. Of course, the invention is not so limited and other types of packaging known in the art can be used for the primary package 101.

As will be described in more detail below, the dispenser 300 contains a plurality of capsules 310 that contain an oral care material. The capsules 310 degrade in the presence of liquid, such as saliva or moisture in the air. As such, the capsules 310 must be packaged in such a way as to protect them against moisture/humidity. However, it will be understood from the description below that the dispenser 300 is created in the manner necessary to protect the capsules 310 against moisture and humidity. Therefore, the second compartment 103 does not need to be moisture sealed in certain embodiments. However, in certain embodiments, the second compartment 103 and/or the primary package 101 can be moisture sealed for an added layer of protection if desired.

The first compartment 102 comprises a front wall 112 and the second compartment 103 comprises a front wall 113. In the exemplary embodiment, the front walls 112, 113 of the first and second compartments 102, 103 are formed of a transparent material so that the oral care implements 200 and dispenser 300 are visible to a consumer within the primary package 101. Of course, the invention is not so limited and the front walls 112, 113 may be translucent or opaque, such as a colored surface, or the front walls 112, 113 may comprise a design to capture the attention of a consumer.

In the exemplary embodiment, the oral care implements 200 are illustrated as manual toothbrushes. However, it should be understood that the oral care implements 200 could be any type of implement used for oral care, such as without limitation tongue scrapers, flossing devices, powered toothbrushes, tooth whitening applicators and the like. As will also be understood from the description below, the oral care implements 200 are preferably packaged separately from the capsules 310 so that there are no requirements regarding packaging of the oral care implements 200 with regard to moisture sealing.

The primary package 101 comprises a top edge 104, a bottom edge 105 and two opposing side edges 106, 107 connected between the top and bottom edges 104, 105 to form a rectangular shape. Of course, the invention is not so limited and the primary package 101 may take on any other shapes as would be known to persons skilled in the art. The shape of the primary package 101 is in no way limiting of the present invention.

The primary package 101 comprises an aperture 108 extending therethrough. The aperture 108 is used for hanging the primary package 101 from a hook in a retail store for display. The aperture 108 may take on any shape, and in certain embodiments the aperture 108 may be omitted altogether. In such embodiments where the aperture 108 is omitted, the primary package 101 may comprise a base upon which the primary package 101 can rest in an upright position.

In the exemplary embodiment, one dispenser 300 is packed in the second compartment 103 and six oral care implements 200 are packed in the first compartment 102. Of course, more or less than six oral care implements 200 may be packed in the first compartment 102. In other words, the number of oral care implements 200 packaged in the kit 100 is in no way limiting of the present invention. Furthermore, it should be understood that the oral care implements 200 can be packed in a tubular container and sold together in the kit 100 with the dispenser 300. Although the oral care implements 200 are illustrated being packaged in a head-to-toe manner, the invention is not so limited. The oral care implements 200 may be packaged in any orientation. However, the head-to-toe packaging may be preferred in embodiments of the kit 100 where it is desired to have a large number of the oral care implements 200.

In certain alternative embodiments, the oral care implements 200 may be sold separately from the dispenser 300. For example, certain oral care implements 200 may be reusable. In such embodiments, the dispenser 300 may be purchased separately from the oral care implements 200 in order to provide additional capsules 310 for use with the oral care implements 200 as will be understood from the description below. Furthermore, in certain other embodiments, the dispenser 300 may contain capsules 310 that are to be used by themselves for breath freshening or other oral care purposes. In other words, the capsules 310 do not need to be used in conjunction with the oral care implements 200 in all embodiments. However, it will be understood from the description below that the capsules 310 are most effective when used in combination with the oral care implements 200.

Figure 2:
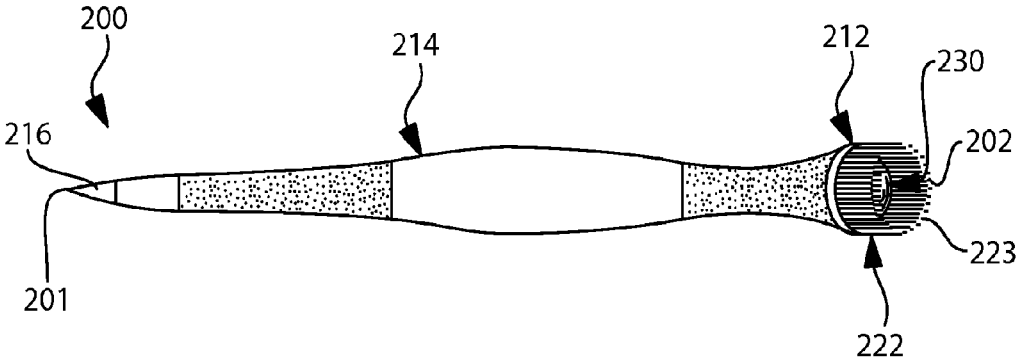
FIG. 2 is a front view of an oral care implement in accordance with one embodiment of the present invention.
Figure 3:
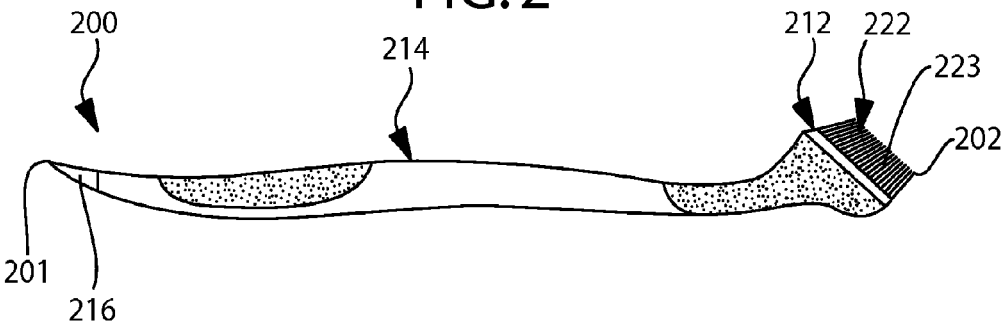
FIG. 3 is a side view of the oral care implement of FIG. 2.

Referring now to FIGS. 2 and 3, the oral care implement 200 will be described in accordance with an embodiment of the present invention. The oral care implement 200 extends from a proximal end 201 to a distal end 202 and includes a head 212 and a handle 214. The head 212 may either be a refill head that is removably connected to the handle 214 or a structure that is permanently connected to the handle 214. The majority of the handle 214 and a portion of the head 212 may be molded from a variety of rigid materials, including without limitation plastics, resins and the like. One suitable rigid material is polypropylene. However, other rigid materials may be used as would be known to persons skilled in the art.

In the illustrated embodiment, the proximal end 201 of the handle 214, which is opposite the end to which the head 212 is connected, comprises an oral care accessory, which in the exemplified embodiment is a toothpick 216. The toothpick 216 is preferably formed of a resilient and soft thermoplastic elastomer. As with the head 212, the toothpick 216 may be a refill toothpick that is removably connected to the handle 214 or may be permanently connected to the handle 214. The toothpick 216 provides a mechanism for spot cleaning between teeth. Forming the toothpick 216 of a soft thermoplastic elastomer provides for a more comfortable interproximal cleaning between the teeth. The toothpick 216 could, however, be made of a stiff, rigid material similar to the main portion of the handle 214, or could simply be a rubber or elastomeric pick adhered or otherwise mounted to the end of the handle 214. Alternatively, a different accessory, such as a strip of dental floss or a tongue cleaning element, may be attached to the proximal end 201 of the handle 214. Moreover, in certain embodiments of the invention, the handle 214 may not include an accessory or may include multiple accessories.

The head 212 comprises a cleaning element block 222. The cleaning element block 222 comprises a plurality of bristles 223 extending from the head 212. The bristles 223 of the cleaning element block 222 may be of any desired shape. For example, the bristles 223 could be of cylindrical shape having a uniform diameter throughout their length. Alternatively, the bristles 223 could taper from the root where they extend from the head 212 to their outer cleaning ends.

Furthermore, the dimensions of the various components of the oral care implement 200 are preferably small. Thus, for example, each bristle 223 of the cleaning element block 222 may extend outwardly from the outer surface of the head 212 a distance no greater than 10 mm and preferably no greater than 8 mm and most preferably no greater than 6 mm. Where tapered cleaning elements are used, the root diameter should be no greater than 1.5 mm, more preferably between 0.5 mm and 1 mm and most preferably no greater than 0.3 mm. The diameter could then decrease in size with distance from the head 212. Preferably, the length of the entire oral care implement 200 is no greater than 5 inches, more preferably no greater than 4 inches and most preferably in the range of 2 to 4 inches.

A central portion of the head 212, which is surrounded by the cleaning element block 222, comprises a depression or cavity 230 for retaining the capsule 310. In certain embodiments, a single one of the capsules 310 is able to nest within the depression 230 at a time. In other words, the depression 230 is sized and configured to retain only one capsule 310. However, the invention is not so limited and in certain other embodiments the depression 230 can contain two or more of the capsules 310 at a time. When alternating capsules 310 contain different oral care materials as will be discussed below, it may be desirable to position two capsules 310 within the depression 230 together for a single brushing experience.

In the exemplary embodiment, the depression 230 is formed into a cleaning element field of the head 212 of the toothbrush 200. As will be described in more detail below with reference to FIG. 5, the capsule 310 is moisture-sensitive and should be protected against high humidity environments in order to prevent premature rupture. As such, the oral care implement 200 is sold without the capsule 310 being retained in the depression 230 so that the oral care implement 200 does not need to be packaged in a moisture-resistant packaging prior to use. Rather, the oral care implement 200 can be exposed to moisture during manufacturing, packaging and sale/display and the capsule 310 can be later inserted into the depression 230 as will be described in more detail below.

In one preferred embodiment of the present invention, the entire structure of the oral care implement 200, including the head 212, the handle 214, and the toothpick 216, is molded as one integral structure, using a conventional two-component injection molding operation typically used in the manufacture of oral care implements. This enables the oral care implement 200 to be economically and quickly manufactured. Although the oral care implement 200 may be constructed in a wide variety of sizes, shapes and relative dimensions, it is preferred that the oral care implement 200 have a small profile so that it is easily portable and can be discreetly used. In one embodiment, it is preferred that the head 212 be small enough to cover a single tooth at a time and that the handle 214 be substantially thinner than conventional, everyday oral care implement handles.

Since the oral care implement 200 is intended to be both small and lightweight, it is preferred that the oral care implement 200 weigh no more than 3 grams in certain embodiments. The small size allows the oral care implement 200 to be held completely within the palm of an adult user's hand. The head 212 is preferably sized to correspond to the size of an individual tooth or an individual tooth and the interproximal areas. While the head 212 could be made in any suitable shape, it is preferably of circular or oval shape and has a maximum lateral dimension or diameter of no greater than 13 mm, preferably no greater than 12 mm and most preferably no greater than 11 mm. Of course, the oral care implement 200 is not limited to any specific dimensions or shapes.

Figure 4:
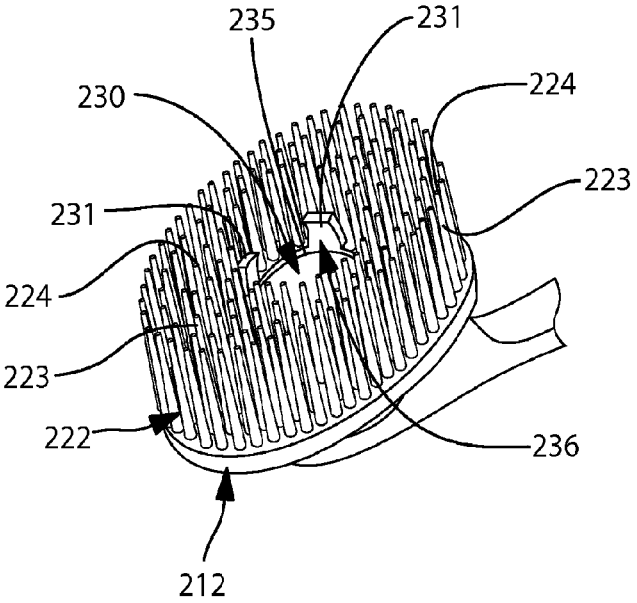
FIG. 4 is a close-up perspective view of a head portion of the oral care implement of FIG. 2.

Referring to FIG. 4, the head 212 of the toothbrush 200 will be described in more detail. In FIG. 4, the depression 230 of the head 212 is empty such that there is no capsule 310 contained in the depression 230. The toothbrush 200 comprises a means for retaining 231 a single capsule 310 within the depression 230. In the exemplary embodiment, the means for retaining 231 is a plurality of prongs that extend upward from the depression 230 into the cleaning element field. However, in other embodiments, the retaining means may be a socket, an upraised wall, a non-toxic adherent or binder, a small opening, and/or combinations thereof.

The prongs 231 retain the capsule 310 beneath the distal ends 224 of the bristles 223 of the cleaning element block 222 so as to keep the capsule 310 submerged within the cleaning element field such that the bristles 223 extend beyond the capsule 310 at the distal ends 224. Of course, the invention is not so limited and in other embodiments the capsule 310 may be retained in a position beyond the distal ends 224 of the bristles 223.

The prongs 231 are preferably flexible prongs. Thus, the prongs 231 may be formed of the same material as the bristles 223 or alternatively may be made of a different material having greater rigidity than the bristles 223. When a capsule 310 is inserted into the depression 230, the prongs will flex downwardly towards the depression 230 slightly while still enabling the capsule 310 to be inserted into the depression 230. Once the capsule 310 is nested in the depression 230, the prongs 231 prevent the capsule 310 from becoming dislodged from the depression 230.

The number of prongs 231 may vary depending on the type of capsule, and the amount of retention force assistance required or desired. As illustrated in FIG. 4, four prongs may be used at four cardinal points around the perimeter of the capsule 310. However, in other embodiments, greater or fewer prongs may be used. For example, some embodiments might use three prongs at triangular points around the perimeter, while other embodiments might use five, six, or more prongs around the perimeter. The prongs 231 may be positioned such that the capsule 310 is held in a centered position with respect to the bristles 223.

In one construction, the prongs 231 are columnar-like structures that extend upwardly from a carrier 235. The columnar-like structures of the prongs 231 may curve inwardly to further assist in holding the capsule 310 in place by an engaging surface 236. The curved columnar-like structures of the prongs 231 may have a length that extends more than halfway up the diameter of the capsule 310 for retention. Hence, a portion of the columnar-like structures may be acutely disposed with respect to a vertical axis of the carrier 235. The combination of the columnar-like structures of the prongs 231 provides a compressive force to hold the capsule 310 in place. The inwardly disposed engaging surface 236 is generally smooth to reliably resist prematurely rupturing the capsule 310 prior to use. Also, the smooth and curved characteristic of the engaging surface 236 provides for a generally uniform distribution of pressure on the surface of the capsule 310. The prongs 231 may assist in rupturing the capsule 310 during brushing.

Figure 5:
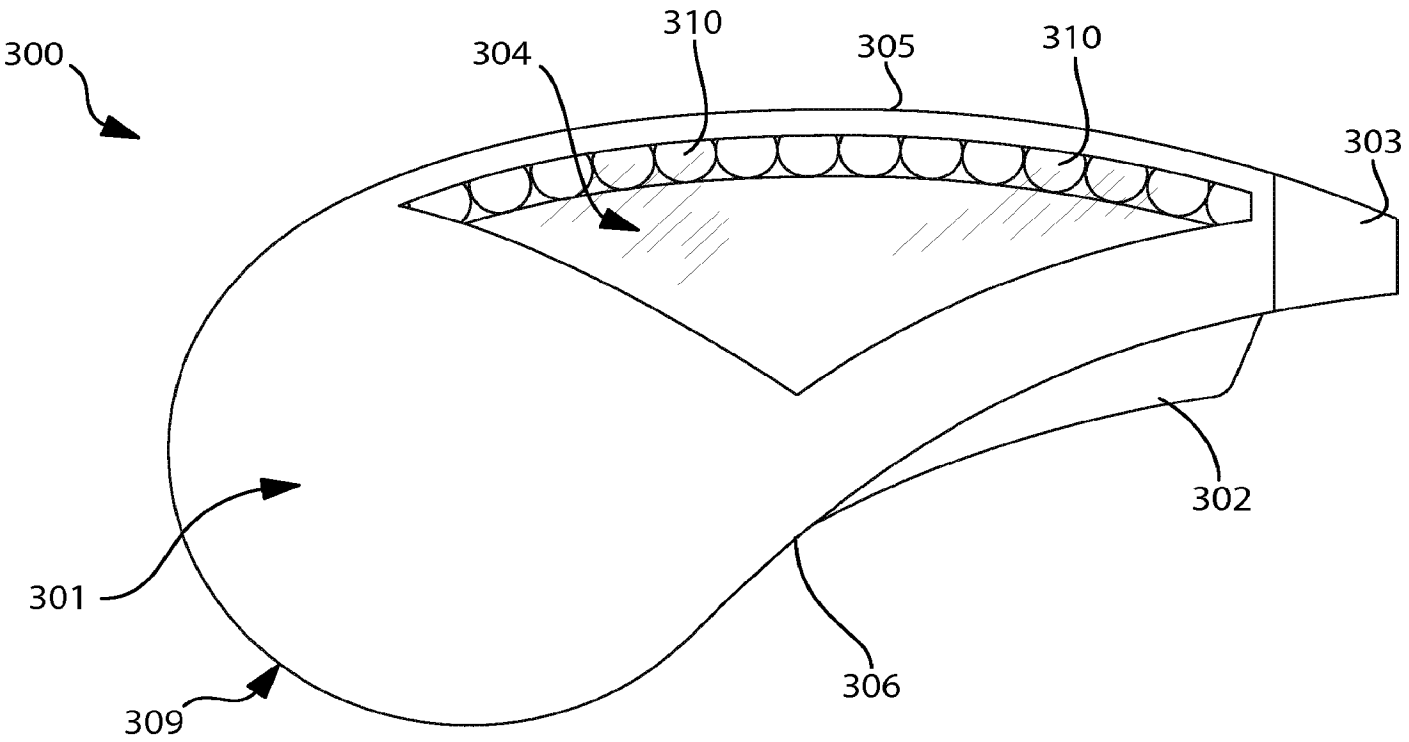
FIG. 5 is a front view of a dispenser in accordance with an embodiment of the present invention.
Figure 6:
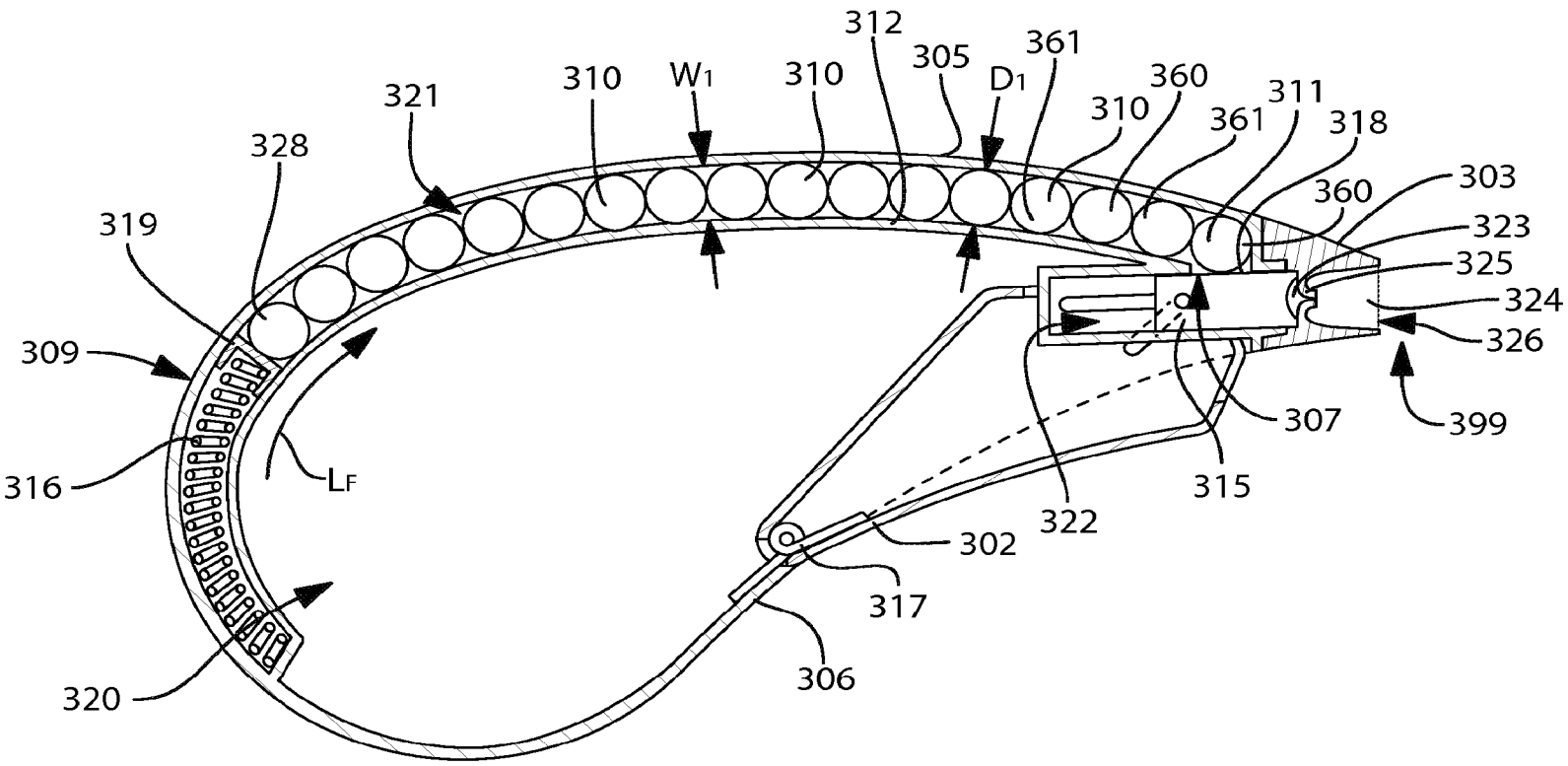
FIG. 6 is a cross-sectional view of the dispenser of FIG. 5 with an actuator in a non-activated position.

Referring to FIGS. 5 and 6, the dispenser 300 will be described in more detail. The dispenser 300 generally comprises a housing 309 having an internal cavity 320 and an internal chamber 321. The housing 309 has an outer surface 301 and a nozzle 303. Furthermore, the dispenser 300 comprises an actuator 302 that extends from a bottom wall 306 of the dispenser 300 and into the internal cavity 320. The internal cavity 320 is an empty space that provides room for the actuator 302 to extend into the housing 309 when the actuator 302 is activated as will be described in detail below. The dispenser 300 is preferably formed of a rigid plastic material, such as without limitation polyethylene, polypropylene, polyester or polyvinylidene chloride. Of course, other materials can be used for the dispenser 300 as would be known to persons skilled in the art.

Referring now solely to FIG. 5, the outer surface 301 of the dispenser 300 comprises a window 304 so that a user can view the contents contained in the internal chamber 321 and/or the internal cavity 320 of the dispenser 300. In certain embodiments, the window 304 enables a user to view the contents contained within the internal chamber 321 only. In the exemplified embodiment, the window 304 provides visual access into a portion of the internal chamber 321 and a portion of the internal cavity 320. The window 304 is preferably a transparent material that can be clearly seen through so that the internal chamber 321 and/or internal cavity 320 is clearly viewable through the housing 309. However, in certain other embodiments, the window 304 may be an opaque or translucent material. It should be understood that the term "transparent material" is intended to mean any type of material that enables a user to see through the material, even if the material is colored or somewhat difficult to see through. The window 304 is position on the outer surface 301 of the dispenser 300 so that capsules 310 that are contained in the internal chamber 321 and/or internal cavity 320 of the dispenser 300 can be viewed from outside of the dispenser 300.

The housing 309 of the dispenser 300 comprises a top wall 305 and the bottom wall 306. The shape of the dispenser 300 is particularly designed to be comfortably held within a single hand of a user. In the exemplified embodiment, the dispenser 300 has a teardrop shape. Of course, the invention is not so limited and the dispenser 300 may take on other shapes as would be known to persons skilled in the art. The actuator 302 extends from the bottom wall 306 of the dispenser 300 through an opening (not shown). Thus, if a user applies pressure to the actuator 302 as will be described in more detail below, the actuator 302 will move through the opening so as to be fully contained within the internal cavity 320 of the dispenser 300.

The nozzle 303 is the portion of the dispenser 300 through which the capsules 310 exit the dispenser 300 so as to be inserted into the depression 230 of the oral care implement 200. In certain embodiments, the nozzle 303 is sized and shaped to be inserted into the depression 230 of the oral care implement 200. In this way, the nozzle 303 can be positioned within the depression 230, and then one of the capsules 310 can be dispensed directly into the depression 230. Due to the flexible configuration of the prongs 231, inserting the capsules 310 directly into the depression 230 as described above will result in the capsules 310 being retained in the depression 230 until use. Dispensing of the capsules 310 will be described in more detail below with reference to FIG. 6-9.

As will also be described in more detail below with reference to FIGS. 6-9, the dispenser 300 may be hermetically sealed so as to prevent moisture from entering into the internal chamber 321 of the dispenser 300. The dispenser 300 is preferably sealed in embodiments where the dispenser 300 is designed to hold and dispense moisture degradable capsules 310 in order to prevent degradation. The details of the capsule 310 are described below.

In the exemplified embodiment, the capsules 310 are substantially spherical beads. Of course, the invention is not so limited and the capsules 310 may take on other shapes as would be known to persons skilled in the art. In one embodiment, the capsules 310 contain an oral care material for treating or otherwise providing health benefits to a user's teeth. In one specific embodiment, the capsules 310 comprise a moisture degradable shell that contains a fluidic oral care material therein. The oral care material may be toothpowder, toothpaste, tooth cleaning gel, mouthwash or a similar dentifrice or oral hygiene product, or a combination of the same. As described above, during use, at least one of the capsule 310 is inserted into the depression 230 of the head 212 of the oral care implement 200. When a user uses the oral care implement 200 to brush his or her teeth, the capsule 310 ruptures thereby expelling its contents (i.e., oral care material) and providing health benefits to a user's teeth.

The capsules 310, or at least the shell of the capsules 310, are moisture-sensitive and should be protected against high humidity environments in order to prevent premature rupture. In other words, the capsules 310, or at least a portion thereof, are susceptible to degradation when subjected to a high humidity atmosphere as it has been discovered that moisture in the air in a high humidity environment can degrade the integrity of the capsules 310. Therefore, the capsules 310 must be packaged so as to be protected against moisture or humidity in the air prior to use. The dispenser 300 achieves this moisture-free environment as will be described in more detail below.

The capsules 310 hold and apply an oral care material onto the tooth cleaning elements 222 of the oral care implement head 212, and ultimately to a user's teeth and/or soft oral tissue surfaces. In certain embodiments, the capsules 310 are liquid-filled gel capsules having a shell comprising frangible, thin walls that easily rupture or burst when rubbed against the teeth. In a preferred embodiment, the capsules 310 degrade when subjected to moisture and, thus, dissolve when mixed with the saliva of a user. As the saliva of a user degrades and dissolves the walls of the capsules 310, the oral care material held therein is excreted. While the degradation of the capsules 310 is a desired characteristic for effectuating end use of the oral care implement 200 by the consumer, the moisture-driven degradation of the capsules 310 presents issues with respect to properly preserving the integrity of the capsules 310 during product manufacturing, packaging, shipping and display in retail stores.

The capsules 310, or at least a portion thereof, are susceptible to degradation when subjected not only to direct contact with liquid water but also to prolonged exposure to atmospheres having a high humidity level. As noted above, it has been discovered that a high humidity environment can degrade the integrity of the capsules 310 and prematurely expel the oral care material or cause the oral care material to dry up. Of course, the exact humidity levels and exposure times that will result in the degradation of the capsules 310 will be determined on a case-by-case basis, considering such factors as the type of capsule 310 being used, the type of oral care material, and the thermal cycling to which the oral care implement 200 is subjected. In view of the foregoing, the capsules 310 are placed in the dispenser 300, which forms a hermetically sealed cavity, thereby protecting the capsules 310 from external moisture which can be in the form of a high humidity atmosphere or liquid water.

Referring now to FIGS. 6 to 10 concurrently, the internal components, as well as the dispensing capabilities, of the dispenser 300 will be described. Referring first to FIG. 6, the dispenser 300 is illustrated with the actuator 302 in a biased position such that a portion of the actuator 302 extends beyond the bottom wall 306 of the housing 309. The dispenser 300 comprises the internal chamber 321, which contains a plurality of the capsules 310 therein. In the exemplified embodiment, the internal chamber 321 is an elongated passageway in which the plurality of capsules 310 are arranged in a single file line.

In certain embodiments, the dispenser 300 can be used for an entire tooth care regimen. For example, the plurality of capsules 310 can comprise a first type of capsules 360 comprising a first oral care material and a second type of capsules 361 comprising a second oral care material, such that the first and second oral care materials are different. For example, the first oral care material could be a tooth whitening agent while the second oral care material may be a tooth sensitivity agent. Of course, other oral care materials can be used. For example, suitable oral care materials include whitening agents, including without limitation, peroxide containing tooth whitening compositions. Suitable peroxide containing tooth whitening compositions are disclosed in U.S. patent Ser. No. 11/403,372, filed Apr. 13, 2006, to the present assignee, the entirety of which is hereby incorporated by reference. While a tooth whitening agent is one of the exemplified active agents in the present invention, any other suitable other care agents can be used with embodiments of the present invention and, thus, stored within the capsules 310. Contemplated oral care agents can be an active or non-active ingredient, including without limitation, antibacterial agents; oxidative or whitening agents; enamel strengthening or repair agents; tooth erosion preventing agents; anti-sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents; anti-inflammatory agents; dry mouth relief ingredients; catalysts to enhance the activity of any of these agents; colorants or aesthetic ingredients; and combinations thereof. The oral care agent in one embodiment is free of (i.e., is not) toothpaste. Instead, the active agent is intended to provide supplemental oral care benefits in addition to merely brushing one's teeth. Other suitable oral care agents could include lip balm or other materials that are typically available in a semi-solid state.

The plurality of capsules 310 can be arranged in the single file line so that the first and second types of capsules 360, 361 are in an alternating order. In this way, a user can use the first type of capsule 360, which may contain a dentifrice, for a normal toothbrushing. Immediately after completing toothbrushing with the first type of capsule 360, a user can dispense the second type of capsule 361 onto the oral care implement 200. The second type of capsule 361 may contain an agent, such as a whitening agent, an antibacterial agent, a sensitivity agent, a tooth strengthening agent or the like. The type of agent used as the first and second oral care agents are not limiting of the present invention and any agents may be used as would be known to persons skilled in the art. Furthermore, more than two different types of capsules may be used so that the tooth care regimen can include using three or more capsules having different oral care materials disposed therein in succession. Additionally, in certain embodiments where the depression 230 of the head 212 of the oral care implement 200 is sized to accommodate two or more capsules 310 at a time, two or more capsules containing oral care agents that react when combined to create a more effective cleaning solution may be used together.

Referring solely now FIG. 6, the internal chamber 321 of the dispenser 300 is defined between the top wall 305 of the housing 309 and a chamber wall 312. Thus, the internal chamber 321 has a width $W_1$ defined by the space between the top wall 305 of the housing 309 and the chamber wall 312. The width $W_1$ is the same as or slightly larger than a diameter $D_1$ of the capsules 310. It should be understood that the width $W_1$ of the internal chamber 321 should be slightly larger than the diameter $D_1$ of the capsules 310 to enable the capsules 310 to move within the internal chamber 321 while only enabling a single file line of the capsules 310 to fit within the internal chamber 321. Furthermore, the internal chamber 321 has an opening 307 that creates a passageway from the internal chamber 321 to a dispensing conduit 322.

The dispensing conduit 322 extends from the internal chamber 321 to an exterior 399 of the dispenser 300. The dispensing conduit 322 comprises a loading zone 323 into which one capsule 311 of the plurality of capsules 310 will be biased upon activation of the actuator 302 as will be described in more detail below. The dispensing conduit 322 further comprises a dispensing zone 324 that is positioned on the opposite side of a valve 325 relative to the loading zone 323. After the capsule 310 passes through the valve 325, as will be described in detail below, the capsule 310 is positioned within the dispensing zone 324. Once in the dispensing zone 324, the capsule 310 can exit the dispenser through a nozzle opening 326 and be placed within the depression 230 of the oral care implement 200.

As noted above, the valve 325 divides the dispensing conduit 322 into a loading zone 323 and a dispensing zone 324. The valve 325 is preferably formed of an elastomeric, rubber or other flexible material such that the valve 325 opens in response to pressure exerted in a direction from the loading zone 323 to the dispensing zone 324. Thus, in response to the pressure as described above, the valve 325 allows the one capsule 311 of the plurality of capsules 310 to pass from the loading zone 323 to the dispensing zone 324 for insertion onto the oral care implement 200. In the exemplified embodiment, the valve 325 is a one-way duck-bill valve. Thus, in its normal, biased state, the valve 325 is closed and creates a hermetic seal. Stated simply, in its biased position, moisture is unable to penetrate through the valve 325 to enter into the internal chamber 321 of the dispenser 300 through the dispensing conduit 322. Thus, the valve 325 protects the capsules 310 positioned within the internal chamber 321 against moisture degradation.

The dispenser 300 further comprises a dispensing subassembly comprising the actuator 302, a drive mechanism 315, a first resilient member 316 and a second resilient member 317. In the exemplified embodiment, the first resilient member 316 is a helical or coil spring and the second resilient member 317 is a torsion spring. Of course, the invention is not so limited and the first and second resilient members 316, 317 may be other members or objects that store mechanical energy. For example, either of the first and second resilient members 316, 317 may be, without limitation, tension springs, compression springs, torsion springs, coil springs, flat springs, cantilever springs, balance springs, leaf springs or the like.

The second resilient member 317 is operably coupled to the actuator 302 and biases the actuator 302 into a non-activated stated. In the non-activated state, a portion of the actuator 302 extends from the bottom wall 306 of the housing 309. Furthermore, in the non-activated state, the drive mechanism 315 is positioned within the loading zone 323 of the dispensing conduit 322 so as to prevent any of the plurality of capsules 310 from entering the dispensing conduit 322 from the internal chamber 321. In other words, in the non-activated state, the opening 307 of the internal chamber 321 is closed by a top edge 318 of the drive mechanism 315. By fully enclosing the internal chamber 321, the capsules 310 provided in the internal chamber 321 are further protected against potential moisture degradation. Furthermore, the top edge 318 of the drive mechanism 315 can be covered by a grommet or gasket to further protect the capsules 321 in the internal chamber 321 against moisture by preventing moisture from entering the internal chamber 321.

The first resilient member 316 imparts a loading force $L_F$ onto the plurality of capsules 310. In the exemplified embodiment, the coil spring presses against the plurality of capsules 310 and forces the plurality of capsules 310 towards the opening 307. The first resilient member 316 includes a contact member 319 that is in continuous contact with a last capsule 328 of the plurality of capsules 310. The contact member 319 is formed of a soft, smooth material, such as an elastomer, rubber or the like. By forming the contact member 319 of a soft, smooth material, the first resilient member 316 will not prematurely rupture the last capsule 328 of the plurality of capsules 310. As noted above, when the actuator 302 is in the biased non-activated state, the opening 307 is closed by the top edge 318 of the drive mechanism 315. As such, in the non-activated state, the first resilient member 316 contains potential energy that will be converted to kinetic energy upon activation of the actuator 302 as will be described in more detail below.

Figure 7:
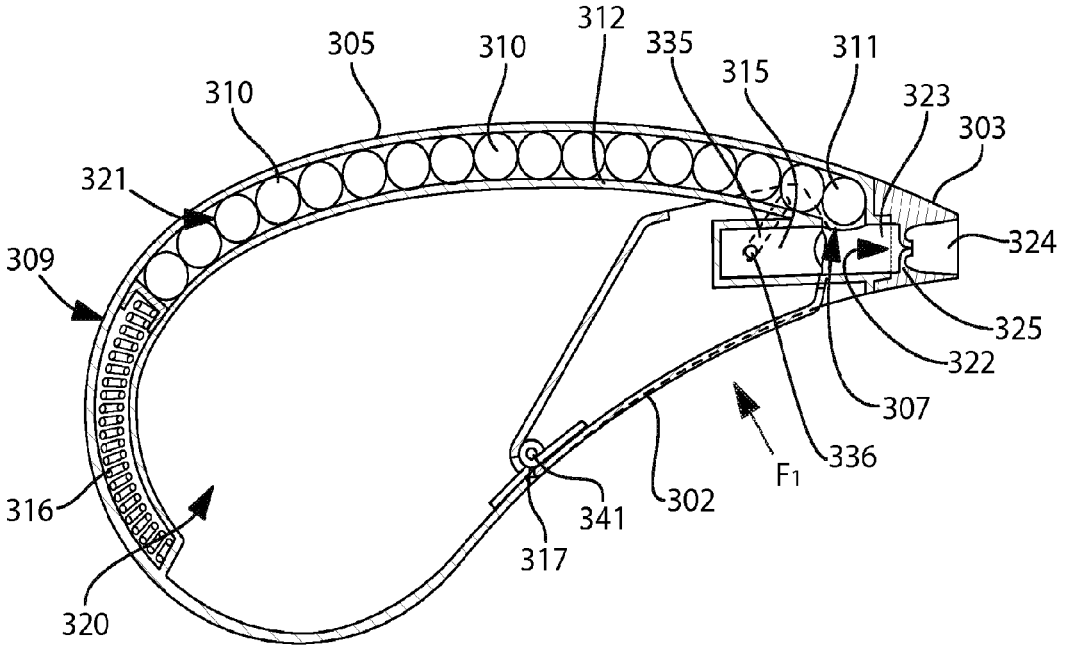
FIG. 7 is a cross-sectional view of the dispenser of FIG. 5 with the actuator in an activated position.
Figure 8:
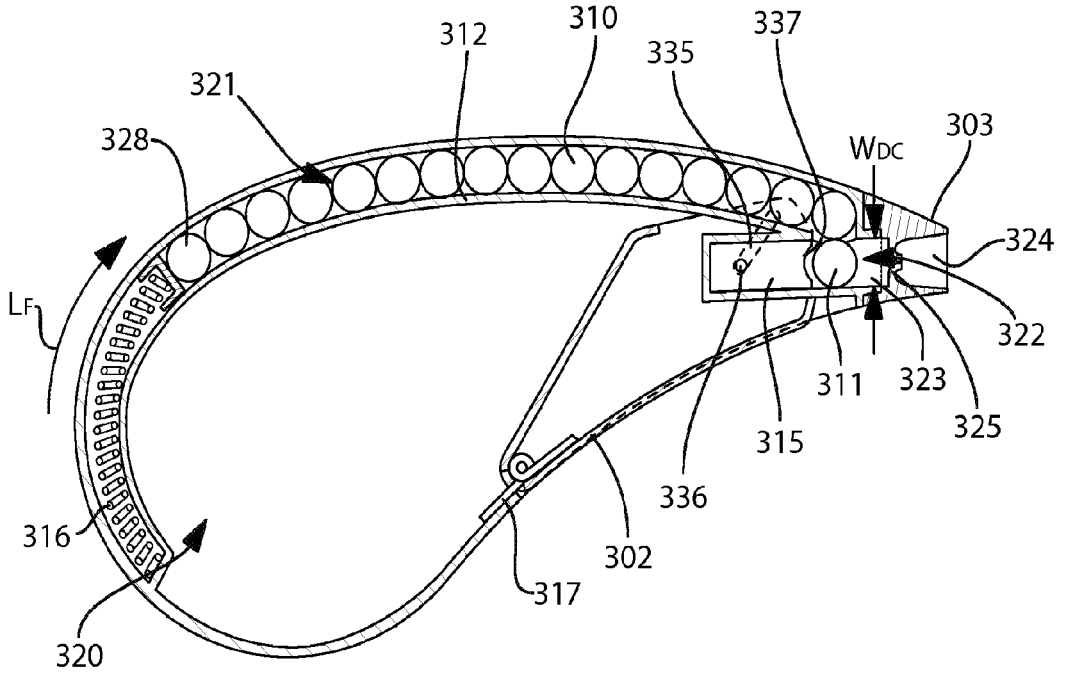
FIG. 8 is a cross-sectional view of the dispenser of FIG. 5 with the actuator in the activated position and a capsule in a loading zone.

Referring to FIGS. 7 and 8 concurrently, activation of the actuator 302 will be described. The actuator 302 comprises slots 334, 335 through which protrusions 336 (second protrusion not shown) of the drive mechanism 315 extend. As the actuator 302 is activated by a user, as will be described below, the protrusions 336 of the drive mechanism 315 slide within the slots 334, 335 of the actuator 302, which in turn moves the drive mechanism 315 within the dispensing conduit 322.

In FIG. 7, a force $F_1$ is applied to the actuator 302. The force $F_1$ can be applied to the actuator 302 by a user gripping the actuator 302 with his or her fingers and having the user's palm resting against the top wall 305 of the dispenser 300. Of course, the invention is not so limited and the force $F_1$ can be applied by other methods so long as the actuator 302 is forced into the internal cavity 320. When the user squeezes his or her fingers in the direction of the arrow $F_1$, the actuator 302 pivots along a pivot point 341. Upon application of the force $F_1$ to the actuator 302, the entire actuator 302 will be positioned within the internal cavity 320 of the dispenser 300. Additionally, the protrusions 336 of the drive mechanism 315 will slide within the slots 334, 335 of the actuator 302, which causes the drive mechanism 315 to slide within the dispensing conduit 322 in a direction away from the valve 325.

As can be seen in FIG. 7, when the drive mechanism 315 slides within the dispensing conduit 322 in a direction away from the valve 325, the opening 307 in the internal chamber 321 is exposed, thereby forming a passageway from the internal chamber 321 to the dispensing conduit 322.

As can be seen in FIG. 8, when the opening 307 in the internal chamber 321 is unobstructed, the one capsule 311 of the plurality of capsules 310 drops into the loading zone 323 of the dispensing conduit 322. This occurs because the first resilient member 316 is continuously imparting the loading force $L_F$ onto the plurality of capsules 310. As a result, when the opening 307 in the internal chamber 321 becomes unobstructed, thereby forming a passageway from the internal chamber 321 to the loading zone 323, the loading force $L_F$ forces the plurality of capsules 310 to move towards the opening 307. Because the one capsule 311 of the plurality of capsules 310 is nearest to the opening 307, the one capsule 311 enters into the loading zone 323 of the dispensing conduit 322.

The dispensing conduit 322 has a width $W_{DC}$. The width $W_{DC}$ of the dispensing conduit 322 is the same as, or slightly larger than the diameter $D_1$ of the plurality of capsules 310. As such, only one of the plurality of capsules 310 is able to fit within the dispensing conduit 322 at one time. This enables the dispenser 300 to dispense a single capsule of the plurality of capsules 311 at a time. In certain embodiments, it may be desirable to dispense more than a single capsule at a time. In such embodiments, the dispensing conduit 322 may have a larger width in order to accommodate two or more capsules therein at a time.

The drive mechanism 315 comprises an engagement surface 337. The engagement surface 337 of the drive mechanism 315 is a concave surface that corresponds to the size and shape of the capsules 310. In certain embodiments, the engagement surface 337 of the drive mechanism 315 is formed of or covered with a soft, elastomeric material. The shape and material of the engagement surface 337 of the drive mechanism 315 are designed so that the capsules 310 are not ruptured during dispensing. In other words, as will be described below, during dispensing the drive mechanism 315 contacts the one capsule 311 to push it through the valve 325. Thus, by forming the engagement surface 337 of the drive mechanism 315 with the shape and material as discussed above, premature rupture of the one capsule 311 during dispensing is prevented. Of course, such a cushioning structure may be omitted if desired.

Figure 9:
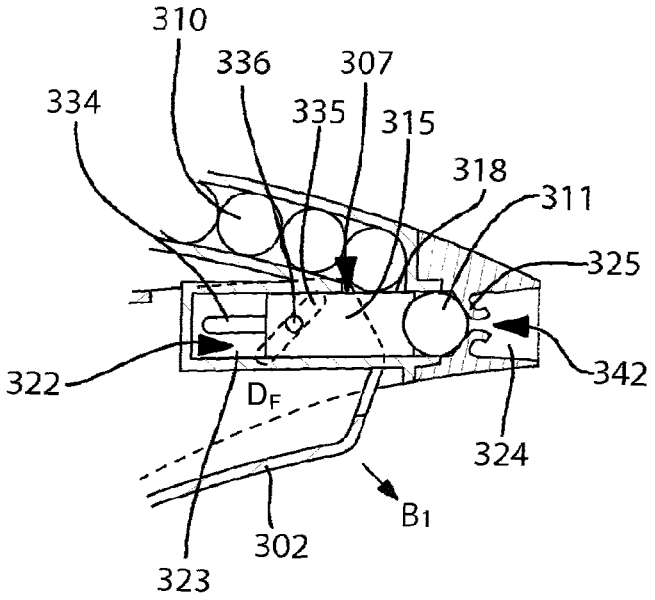
FIG. 9 is a close-up cross-sectional view of a portion of the dispenser of FIG. 5 with a drive mechanism imparting a dispensing force onto the capsule.
Figure 10:
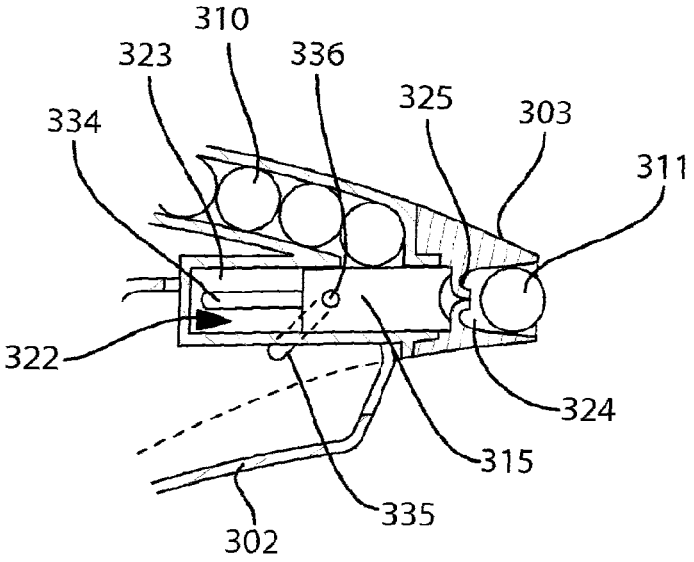
FIG. 10 is a close-up cross-sectional view of the portion of the dispenser of FIG. 5 after the capsule has passed through a valve.

Referring to FIGS. 9 and 10 concurrently, the dispensing of the one capsule 311 of the plurality of capsules 310 from the dispensing conduit 322 will be described. After the one capsule 311 of the plurality of capsules 310 becomes positioned within the loading zone 323 of the dispensing conduit 322, the user releases the actuator 302. As described above, the actuator 302 is biased into a non-activated state. As such, when the user releases the actuator 302 by the cessation of the force $F_1$ to the actuator 302, the actuator 302 extends back beyond the bottom wall 306 of the housing 309 of the dispenser 300 in the direction of the arrow $B_1$. The second resilient member 317 biases the actuator 302 back into the non-activated state as soon as the force $F_1$ is no longer applied.

Upon biasing the actuator 302 into the non-activated state, the protrusions 336 of the drive mechanism 315 slide within the slots 334, 335 of the actuator 302 in the direction of the valve 325. Thus, the drive mechanism 315 imparts a dispensing force $D_F$ onto the one capsule 311 in the direction of the arrow. The dispensing force $D_F$ of the drive mechanism 315 is imparted onto the one capsule 311 of the plurality of capsules 310, which pushes the one capsule 311 towards the valve 325. As the one capsule 311 is driven towards the valve 325, the valve 325 is forced into an open state whereby an opening 342 in the valve 325 creates a passageway from the loading zone 323 to the dispensing zone 324.

As the drive mechanism 315 drives the one capsule 311 through the opening 342 in the valve 325, the top edge 318 of the drive mechanism 315 blocks the opening 307 of the internal chamber 321. As such, while the one capsule 311 is being dispensed, the plurality of capsules 310 are prevented from entering into the dispensing conduit 322 from the internal chamber 322.

Referring now to FIG. 10, as the drive mechanism 315 continues to apply the dispensing force $D_F$ to the one capsule 311, the one capsule 311 passes completely through the valve 325 into the dispensing zone 324. As the one capsule 311 passes through the opening 342 in the valve 325, the valve 325 automatically closes the opening 342 and returns to a sealed state so as to prevent moisture from entering into the internal chamber 321 through the dispensing conduit 322.

Once in the dispensing zone 324, the one capsule 311 can easily be removed from the dispenser 300 through the nozzle opening 326. In certain embodiments as discussed above, the nozzle 303 is sized and shaped to be inserted into the depression 230 of the oral care implement 200. In such embodiments, the dispensing force $D_F$ may be equal to or greater than a force required to operably insert the one capsule 311 into the depression 230 through the prongs 231. As such, the nozzle 303 can simply be aligned with or inserted into the depression 230 in the head 214 of the oral care implement 200 and the actuator 302 activated to properly position the one capsule 311 in the depression 230 to be retained by the prongs 231.

Referring again to FIGS. 6 to 10 concurrently, a method of applying oral care material to an oral surface will be described. In performing the method, one of the oral care implements 200 and the dispenser 300 described above will be provided (i.e., obtained by a user). The dispenser 300 is positioned adjacent the oral care implement 200 so that one of the plurality of capsules 310 can be dispensed from the dispenser 300 and disposed on the oral care implement 200. Specifically, the dispenser 300 is positioned adjacent the oral care implement 200 so that the nozzle 303 is positioned within the depression 230 of the oral care implement 200. The dispenser 300 is then activated as described above to impart the dispensing force $F_D$ onto the one capsule 311 of the plurality of capsules 310, thereby forcing the one capsule 10 through the valve 325 and onto the oral care implement 200. In preferred embodiments, the dispensing force $F_D$ is equal to or greater than a force required to operably insert the one capsule 311 into the prongs 231 of the oral care implement 200.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

What is claimed is:

1. An oral care dispenser comprising:

a housing haying an internal chamber containing a plurality of capsules containing an oral care material;

a dispensing conduit extending from the internal chamber to an exterior of the dispenser;

a valve positioned in the dispensing conduit, the valve biased into a sealed state that prevents moisture from entering the internal chamber through the dispensing conduit; and a dispensing subassembly configured to dispense one of the plurality of capsules at a time from the internal chamber through the valve, the valve being forced into an open state that allows the one capsule to pass therethrough when the one capsule is subjected to a dispensing force imparted by the dispensing subassembly, the valve automatically returning to the sealed state after the one capsule passes through the valve;

wherein the dispensing subassembly comprises an actuator and a drive mechanism that imparts the dispensing force onto the one capsule when the actuator is activated by a user; and wherein the dispensing subassembly further comprises a first resilient member that imparts a loading force onto the plurality of capsules that biases the one capsule into a loading zone of the dispensing conduit.

2. The oral care dispenser according to claim 1 wherein the capsules comprise a moisture degradable shell containing a fluidic oral care material therein.

3. The oral care dispenser according to claim 1 wherein the capsules are substantially spherical beads.

4. The oral care dispenser according to claim 1 wherein the dispensing subassembly further comprises a second resilient member that biases the actuator and drive member into a non-activated state in which the plurality of capsules are prevented from entering the dispensing conduit from the internal chamber.

5. The oral care dispenser according to claim 1 wherein the internal chamber is an elongated passageway in which the plurality of capsules are arranged in single file.

6. The oral care dispenser according to claim 1 wherein the internal chamber is an elongated passageway in which the plurality of capsules are arranged in single file.

7. The oral care dispenser according to claim 6 wherein the plurality of capsules comprise at least a first type of capsules comprising a first oral care material and a second type of capsules comprising a second oral care material, the first oral care material being different than the second oral care material, and the plurality of capsules arranged in the single file so that the first and second types of capsules are in an alternating order.

8. The oral care dispenser according to claim 1 wherein the valve is formed of an elastomeric material.

9. The oral care dispenser according to claim 8 wherein the valve is a duck-billed valve.

10. An oral care kit comprising:

at least one toothbrush; and a dispenser comprising:

a housing having an internal chamber containing a plurality of capsules containing an oral care material;

a dispensing conduit extending from the internal chamber to an exterior of the dispenser;

a valve positioned in the dispensing conduit, the valve biased into a sealed state that prevents moisture from entering the internal chamber through the dispensing conduit;

a dispensing subassembly configured to dispense one of the plurality of capsules at a time from the internal chamber through the valve, the valve being forced into an open state that allows the one capsule to pass therethrough when the one capsule is subjected to a dispensing force imparted by the dispensing subassembly, the valve automatically returning to the sealed state after the one capsule passes through the valve;

wherein the dispensing subassembly comprises an actuator and a drive mechanism that imparts the dispensing force onto the one capsule when the actuator is activated by a user; and wherein the dispensing subassembly further comprises a first resilient member that imparts a loading force onto the plurality of capsules that biases the one capsule into a loading zone of the dispensing conduit.

11. The oral care kit according to claim 10 wherein the dispensing subassembly further comprises a second resilient member that biases the actuator and drive mechanism into a non-activated state in which the plurality of capsules are prevented from entering the dispensing conduit from the internal chamber.

12. The oral care kit according to claim 10 wherein the internal chamber is an elongated passageway in which the plurality of capsules are arranged in single file.

13. The oral care kit according to claim 12 wherein the valve is a duck-billed valve.

14. The oral care kit according to claim 10 wherein the valve is formed of an elastomeric material.

15. The oral care kit according to claim 10 wherein the toothbrush comprises a handle and a head, the head having a depression in which the one capsule can nest.

16. The oral care kit according to claim 15 wherein the dispenser further comprises a nozzle that is sized and shaped to be inserted into the depression of the toothbrush.

17. The oral care kit according to claim 15 wherein the toothbrush comprises a means for retaining the one capsule within the depression, and wherein the dispensing force is equal to or greater than a force required to operably insert the one capsule into the retaining means.

18. The oral care kit according to claim 15 wherein the depression is formed into a cleaning element field of the head of the toothbrush.

19. The oral care kit according to claim 10 wherein the capsules comprise a moisture degradable shell containing a fluidic oral care material therein.

20. The oral care kit according to claim 10 further comprising a plurality of the toothbrushes.

21. The oral care kit according to claim 10 wherein the toothbrush and the dispenser are located within a common primary package.

22. The oral care kit according to claim 10 wherein the toothbrush and the dispenser are separate components.

23. The oral care kit according to claim 10 wherein the housing comprises a window for viewing contents of the internal chamber.

24. An oral care kit comprising:

at least one toothbrush; and a dispenser comprising:

a housing having an internal chamber containing a plurality of capsules containing an oral care material;

a dispensing conduit extending from the internal chamber to an exterior of the dispenser;

a valve positioned in the dispensing conduit, the valve biased into a sealed state that prevents moisture from entering the internal chamber through the dispensing conduit;

a dispensing subassembly configured to dispense one of the plurality of capsules at a time from the internal chamber through the valve, the valve being forced into an open state that allows the one capsule to pass therethrough when the one capsule is subjected to a dispensing force imparted by the dispensing subassembly, the valve automatically returning to the sealed state after the one capsule passes through the valve;

wherein the plurality of capsules comprise a first type of capsules comprising a first oral care material and a second type of capsules comprising a second oral care material, the first oral care material being different than the second oral care material.

25. A method of applying an oral care material to an oral surface comprising:

a) providing a toothbrush;

b) providing a dispenser comprising: a housing having an internal chamber containing a plurality of capsules containing an oral care material; a dispensing conduit extending from the internal chamber to an exterior of the dispenser; a valve positioned in the dispensing conduit, the valve biased into a sealed state that prevents moisture from entering the internal chamber through the dispensing conduit; and a dispensing subassembly configured to dispense one of the plurality of capsules at a time from the internal chamber through the valve;

c) positioning the dispenser adjacent the toothbrush; and d) activating the dispenser subassembly, the dispenser subassembly imparting a dispensing force onto the one capsule, thereby forcing the one capsule through the valve and onto the toothbrush, the valve automatically returning to the sealed state after the one capsule passes through the valve;

wherein the toothbrush comprises a handle and head having a depression, and wherein step d) comprises dispensing the one capsule into the depression of the toothbrush; and wherein the toothbrush further comprises a means for retaining the one capsule within the depression, wherein the dispensing force is equal to or greater than a force required to operably insert the one capsule into the retaining means, and wherein step d) further comprises positioning a nozzle of the dispenser in the depression.

* * * * *